US005881896A

United States Patent [19]

Presnell et al.

[11] Patent Number: 5,881,896

[45] Date of Patent: Mar. 16, 1999

[54] REFUSE CONTAINER WITH ROLL-BACK LID

[75] Inventors: Donald C. Presnell, Stephens City; Harold E. Ruckman; Kirstin J. van Duelmen, both of Winchester, all of Va.

[73] Assignee: Rubbermaid Commercial Products Inc., Winchester, Va.

[21] Appl. No.: 827,603

[22] Filed: Mar. 28, 1997

[51] Int. Cl.[6] ..... B65D 43/26

[52] U.S. Cl. ..... 220/252; 220/263; 220/908

[58] Field of Search ..... 220/252, 262–264, 220/908, 909, 335, 337, 254

[56] References Cited

U.S. PATENT DOCUMENTS

| | | |
|---|---|---|
| 242,254 | 5/1881 | Bird . |
| D. 261,720 | 11/1981 | Brazis . |
| D. 319,905 | 9/1991 | Hotchkiss . |
| D. 322,350 | 12/1991 | Craft, Jr. et al. . |
| D. 332,852 | 1/1993 | Delmerico . |
| D. 368,563 | 4/1996 | Brightbill et al. . |
| 933,570 | 9/1909 | Ludeman . |
| 1,333,051 | 3/1920 | Young . |
| 2,254,141 | 8/1941 | Garcia . |
| 2,351,597 | 6/1944 | Burlin . |
| 4,892,218 | 1/1990 | Reiling . |
| 4,953,732 | 9/1990 | Cocks . |
| 4,972,966 | 11/1990 | Craft, Jr. . |
| 5,011,036 | 4/1991 | Souza et al. . |
| 5,170,904 | 12/1992 | Neuhaus . |
| 5,257,638 | 11/1993 | Alvemarker . |
| 5,474,201 | 12/1995 | Liu . |

OTHER PUBLICATIONS

"Child–safe step–on receptacles" advertisement, White, 1 page, (undated).

"The Defenders Step Cans" advertisement, 2 pages (1995).

Fisher Scientific Advertisement, 2 pages (1993/1994).

"Safety Step" advertisement, The Witt Company, 4 pages (1993).

"Step–On containers" advertisement, Rubbermaid Commercial Products, 4 pages, (1992).

"Step–On Containers" advertisement, Rubbermaid, 1 page, (undated).

"Unicorn" products guide/advertisement, 4 pages, (undated).

"Waste Containers" advertisement, United Receptacle, 1 page, (undated).

*Primary Examiner*—Stephen K. Cronin
*Assistant Examiner*—Nathan Newhouse
*Attorney, Agent, or Firm*—Renner, Kenner, Greive, Bobak, Taylor & Weber

[57] ABSTRACT

A refuse container (10) includes an open-top receptacle (12) that is selectively closed by a removable hood (14). The hood (14) carries a roll-back door (22) that is operatively connected to a foot pedal (16) by a pair of lifters (18). The container (10) is designed so that the door (22) rolls back to an open position when the foot pedal (16) is depressed. The connection between the foot pedal (16) and the door (22) allows the hood (14) to be removed from the receptacle (12) without requiring the user to disconnect the linkage. As such, the linkage is automatically disassembled when the hood (14) is removed and automatically reassembled when the hood (14) is placed on the receptacle (12). The connection generally includes an engagement bar (70) that projects from an upper end of each lifter (18). The door (22) has a pair of arms (88) that each have a slot (84) therein. When the hood (14) is placed on the receptacle (12), the slots (86) engage the engagement bars (70). When the pedal (16) is depressed, the lifters (18) force the engagement bars (70) into the slots (86) causing the arms (88) to pivot about pivot pins (92) thus rolling the door (22) back into the hood (14).

19 Claims, 8 Drawing Sheets

REFUSE CONTAINER WITH ROLL-BACK LID

TECHNICAL FIELD

This invention relates generally to containers and, in particular, to refuse containers having lids that are pedal operated. Specifically, the invention relates to a refuse container having a pedal-operated, roll-back door in a removable lid wherein removal of the lid automatically disconnects or disassembles the linkage between the door and the pedal, and replacement of the lid automatically reconnects or reassembles the linkage.

BACKGROUND ART

A refuse container having a door that is opened by the depression of a foot pedal is generally desirable because the act of opening does not require a free hand, and the user does not have to touch the container to deposit trash. Conventional pedal-operated refuse containers typically utilize a flat lid or flap at the top of the container. The prior art containers are typically round or square and may be manufactured of metal or plastic or a combination of both materials. The lids or flaps are typically permanently attached to the container and have a mechanical linkage which connects the lid or flap to a pedal. The mechanical linkage is usually permanently attached to the lid or flap such that the lid or flap may not be easily removed.

While the aforementioned pedal-operated refuse containers work well, several deficiencies make their use less than satisfactory. One type of prior art device is a bullet-shaped or cylindrical shell having an inwardly moving flap. This type of bullet-shaped container is typically slid over a liner that catches and contains the disposed rubbish. The flap often does not provide enough opening clearance to easily place rubbish into the liner when it is nearly full. To empty the liner, a person must lift the container over the liner. The practice of having to lift the heavy metal or plastic container up over the rigid liner to empty the trash proves to be cumbersome and hazardous often resulting in back strain.

Pedal-operated containers that employ a pivoting top lid which opens upwardly also have drawbacks and undesirable characteristics. First, the additional overhead space required for the upward movement of the lid prevents the container from being used under low countertops or tables. Second, the action of the lid swinging upwardly and pulling away from the container creates a vacuum, pulling into the surrounding area airborne pathogens and bacteria. Such air flows are unsatisfactory when the container is being used in a hospital, commercial kitchen, or a health care environment.

Both styles of containers mentioned above are often difficult to clean because the lids are typically permanently attached to the container base. This is particularly true in the case of the bullet-shaped container where a person must reach high into the container to clean behind the flap. To thoroughly clean the container, a person must disconnect the mechanical linkage between the foot pedal and the door and remove the door from the container. This practice is undesirable due to the time and effort involved.

Thus, the need exists for a refuse container having a door that may be selectively opened by a foot pedal to a position where it does not create an undesirable air flow or extend above the container, or extend into the refuse containing space of the container. The need also exists for a refuse container having a hood that may be removed from the base such that the inside of the door and hood may be cleaned without the requirement of disassembling the mechanical linkage.

DISCLOSURE OF THE INVENTION

It is thus an object of the present invention to provide a refuse container having a door that rolls back into the lid.

It is another object of the present invention to provide a refuse container, as above, that has a roll-back door that may be opened by depressing a foot pedal.

It is a further object of the present invention to provide a refuse container, as above, that has a pair of lifters that operatively connect the door to the foot pedal.

It is yet another object of the present invention to provide a refuse container, as above, that has an open-top receptacle as a base that carries the foot pedal and the lifters, the receptacle having channels in which the lifters reside and a guard that maintains the position of the lifters.

It is an additional object of the present invention to provide a refuse container, as above, wherein the roll-back door is carried by a removable hood.

It is still a further object of the present invention to provide a refuse container, as above, wherein the connection between the foot pedal and the door is automatically broken when the hood is removed from the open-top receptacle and automatically formed when the hood is replaced.

These and other objects of the present invention, which will become apparent from the description to follow, are accomplished by the improvements hereinafter described and claimed.

In general, a refuse container made in accordance with the present invention includes a receptacle having an open top. A removable hood selectively closes the open-top of the receptacle and includes a door which is moveable between an open position and a closed position. A foot pedal is carried by the receptacle, and a link is provided between the pedal and the door such that the door is moved to the open position from the closed position when the pedal is depressed. The link between the door and the pedal is automatically disassembled when the hood is removed from the receptacle.

A preferred exemplary refuse container incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
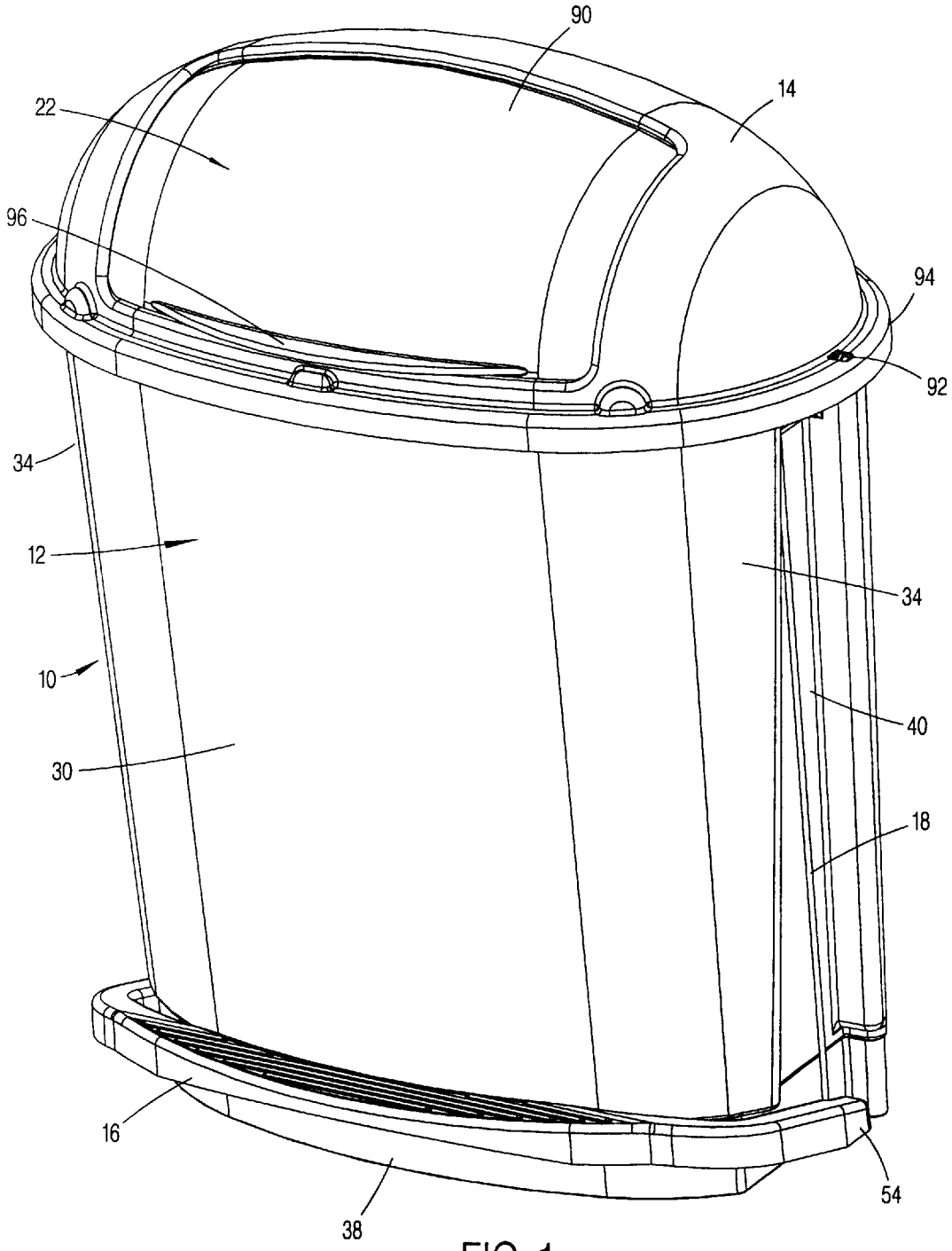
FIG. 1 is a perspective view of a refuse container made in accordance with the concepts of the present invention.

A refuse container made in accordance with the concepts of the present invention is indicated generally in the accompanying drawings by the numeral 10. Refuse container 10 may be fabricated from any of a variety of materials, but it has been found that fabricating container 10 from any suitable plastic results in a lightweight device that is relatively easy and inexpensive to manufacture.

Refuse container 10 includes an open-top receptacle generally indicated by the numeral 12 and a hood 14 that is removably attached to the open top of receptacle 12. Receptacle 12 carries a foot pedal 16 that is operatively connected to a pair of lifters 18. Hood 14 has an opening 20 that is selectively closed by a door 22. In general, lifters 18 function as links that link door 22 to pedal 16 such that door 22 is moved from a closed position to an open position when a user depresses foot pedal 16 causing lifters 18 to move upwardly resulting in door 22 rolling back into hood 14.

Open-top receptacle 12 includes a front wall 30 and a rear wall 32 that are joined by a pair of side walls 34. Receptacle 12 is closed at its lower end by a bottom wall 36. An inset band 38 is formed at the lower portion of receptacle 12 to provide a space for the operation of pedal 16. While receptacle 12 is shown as having oval cross section in the preferred embodiment depicted in the drawings, the particular shape of receptacle 12 is not critical to the invention.

An inset channel 40 that extends upwardly from inset band 38 is formed in each side wall 34. A lip 42 is formed along the upper edge of receptacle 12 to provide a seat for hood 14. A retaining opening 44 is formed in lip 42 substantially above each inset channel 40. Retaining opening 44 is formed by a bridge 46 that at least partially positions lifters 18. A protuberance 48 is also disposed in each channel 40 to help position lifters 18. Protuberance 48 may be sized such that each lifter 18 is slidingly disposed between protuberance 48 and bridge 46. As such, lifters 18 are prevented from undesirably rattling while in use and, more importantly, the position of lifters 18 does not significantly change when lifters 18 are disconnected or disassembled from door 22 when hood 14 is removed. The inset configuration of channels 40 also provides strength and rigidity to receptacle 12. Of course, channels 40 are not required for container 10 to function. In other embodiments of the present invention, lifters 18 may simply run along the outside or inside of receptacle 12. In such configuration, it would be desirable to provide a retaining device to prevent lifters 18 from excessively moving.

Figure 5:
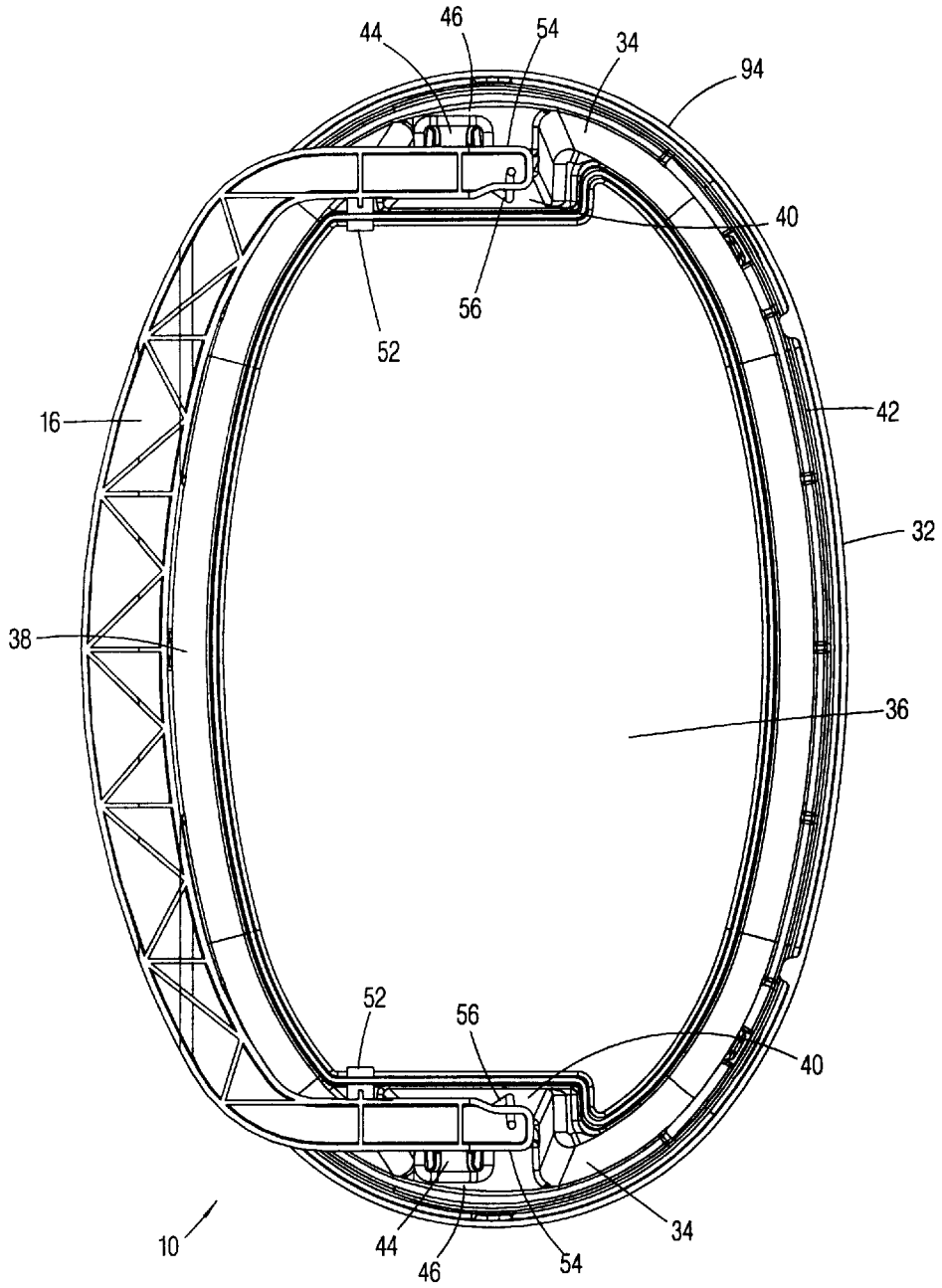
FIG. 5 is a bottom plan view of the refuse container.

Foot pedal 16 is pivotally carried by receptacle 12 by a pair of pins 52 (FIG. 5). Pins 52 are disposed at the mid-point of pedal 16 to create a lever configuration where the lifting end 54 of pedal 16 is directed upwardly when pedal 16 is depressed. Lifters 18 may be connected to lifting end 54 of pedal 16 by any conventional method known in the art. For example, the lifters 18 may be provided with a horizontal portion 56 that fits into an opening in lifting end 54. If necessary, an appropriate keeper may be connected to horizontal portion 56 of each lifter 18 to prevent portions 56 from becoming disconnected from lifting end 54 of pedal 16.

Figure 2:
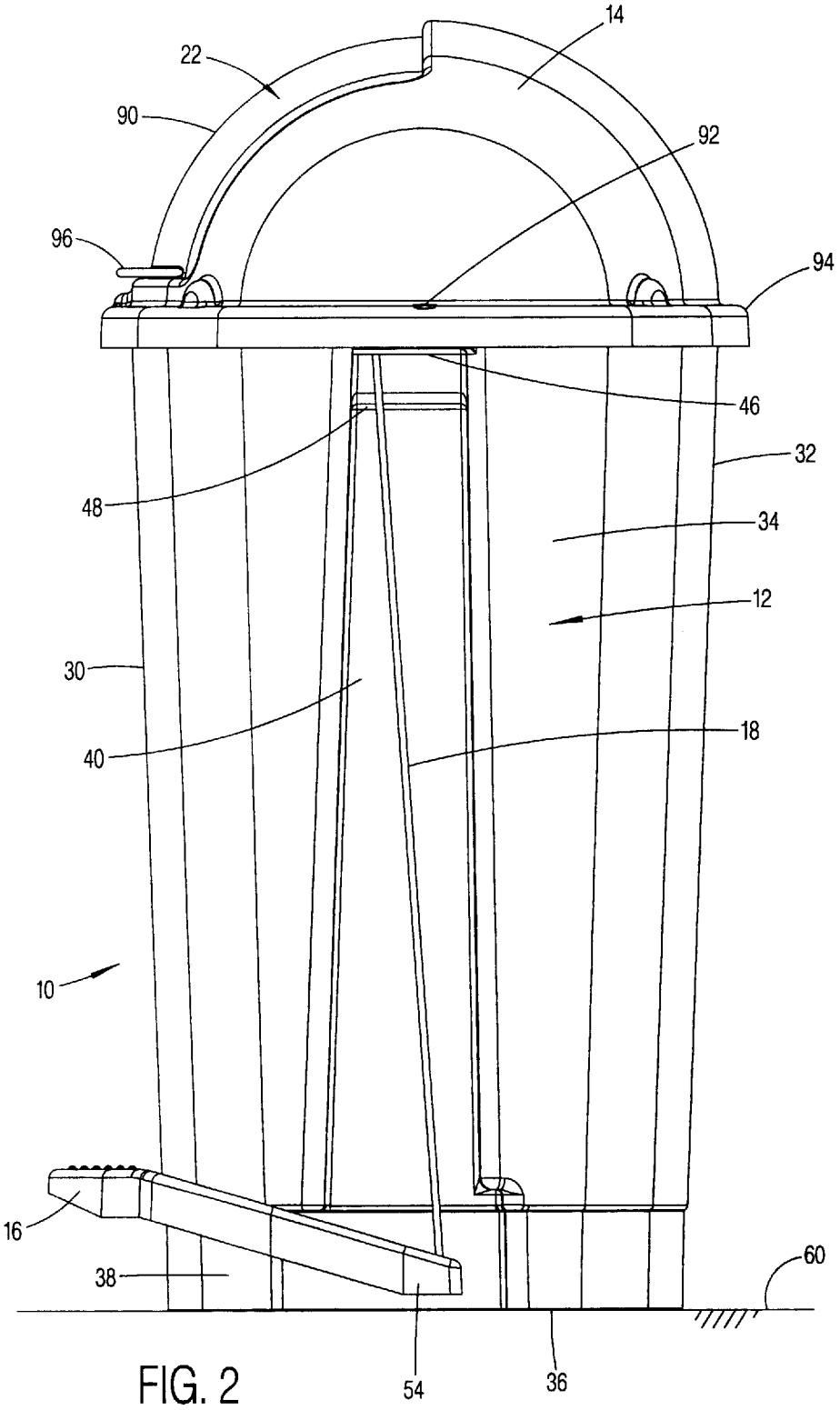
FIG. 2 is a side elevational view of the refuse container with the door being shown in the closed position.
Figure 3:
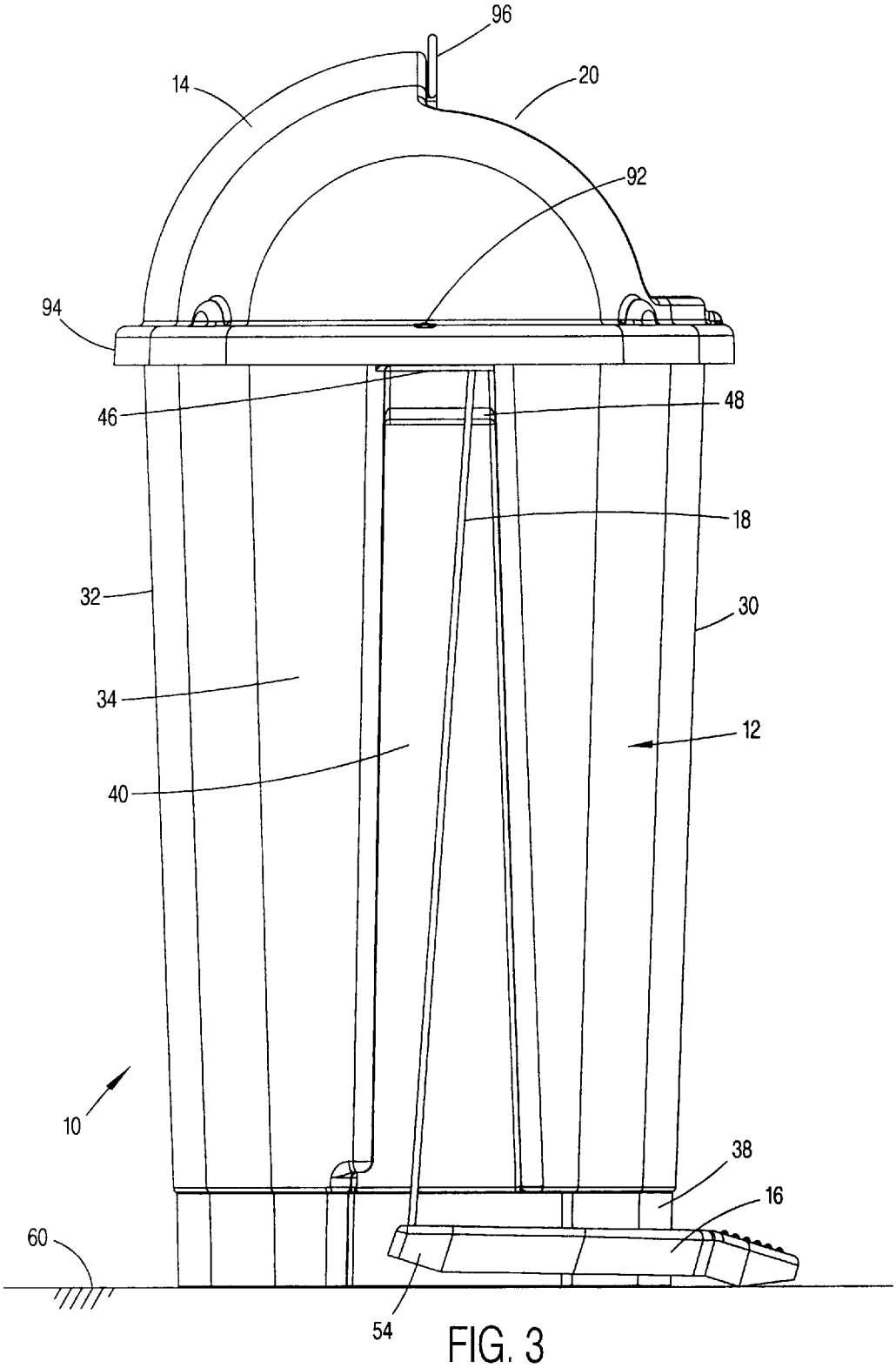
FIG. 3 is a side elevational view of the opposite side of the container shown in FIG. 2 with the door being shown in the open position.
Figure 4:
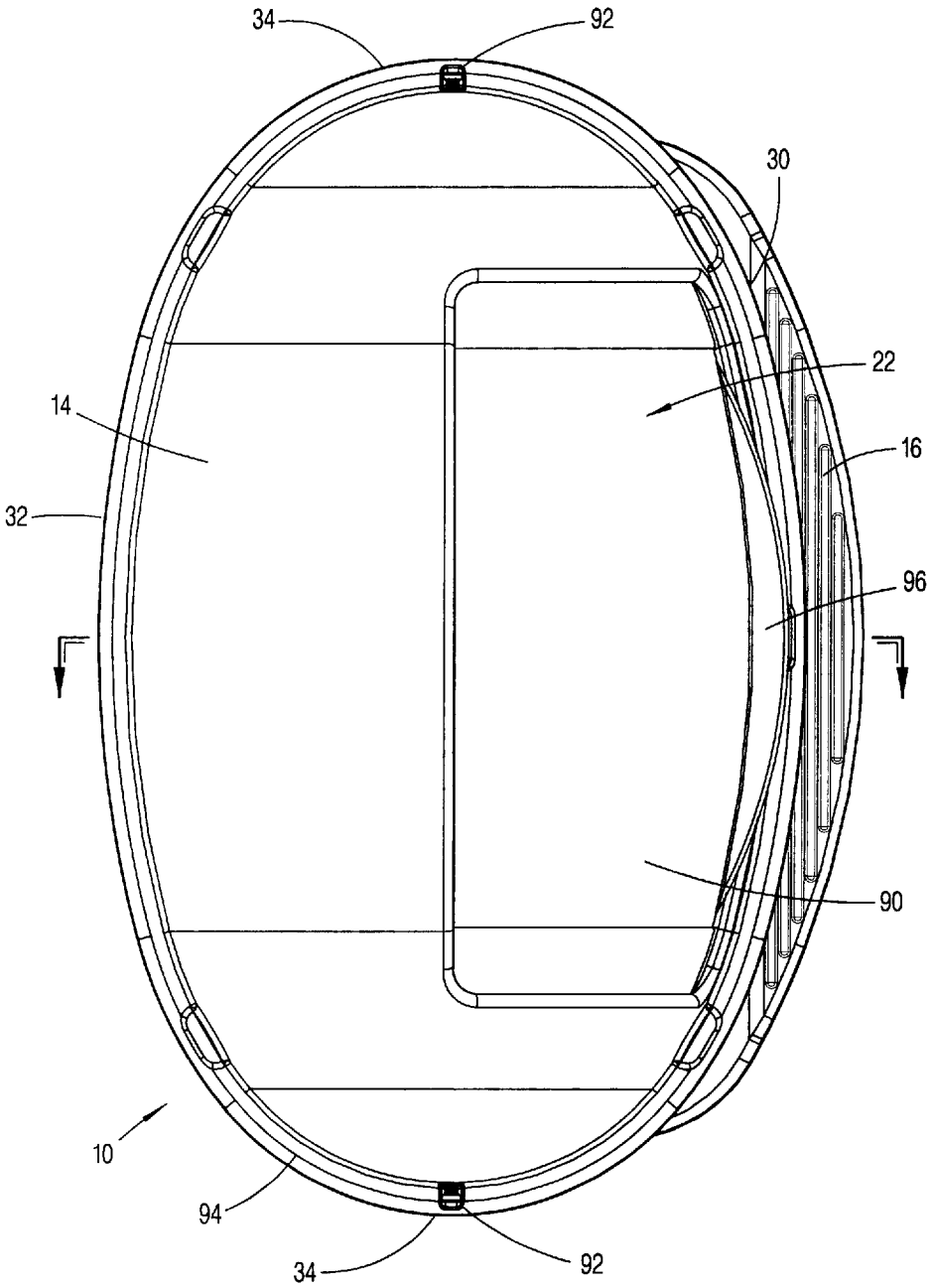
FIG. 4 is a top plan view of the refuse container with the door being shown in the closed position.

Pedal 16 is configured to engage the surface 60 on which receptacle 12 is placed to limit the travel of lifters 18. As can be seen in FIG. 2, pedal 16 is above surface 60 while in the resting position with door 22 closed. When pedal 16 is depressed, door 22 moves to the open position, and as shown in FIG. 3, pedal 16 engages surface 60 just as door 22 reaches the fully open position. Such a configuration prevents damage to container 10 that would result if a user were to stand on pedal 16 and try to force door 22 beyond the open position. The pedal and lifter configuration depicted in the preferred embodiment is only exemplary. The present invention also contemplates a configuration that employs a smaller pedal and a single lifter. Two lifters 18 are preferable to build redundancy into container 10 such that, for example, if one lifter 18 should fail, the container 10 will still operate to be opened.

Lifters 18 engage door 22 in such a way that hood 14 may be removed from receptacle 12 causing lifters 18 to automatically disengage door 22. The configuration also allows the connection or engagement between lifters 18 and door 22 to be automatically formed when hood 14 is placed back on receptacle 12. The connections or engagements are "automatically" made and broken because the user does not have to perform any extra task to make or break the connection or engagement. As such, manipulation of a connecting element such as a bolt, screw, nut, or pin is not required to make or break the connection or engagement. This configuration allows hood 14 to be removed when receptacle 12 must be emptied and also facilitates cleaning of the interior of hood 14 and door 22.

To provide for such an automatic disassembly and assembly, each lifter 18 is provided with an engagement bar 70 that is configured and located in such a way so as to automatically engage door 22 when hood 14 is placed on receptacle 12. In the preferred embodiment of the present invention, engagement bars 70 extend horizontally from lifters 18 and are provided with a curved portion 72 that centers door 22 on bar 70. A second horizontal portion 74 is disposed below engagement bar 70 and connected thereto by a vertical portion 76. Vertical portion 76 and horizontal portion 74 are configured such that a gap 78 is formed between the end 80 of second horizontal portion 74 and lifter 18. When lifter 18 is installed on receptacle 12, the interior wall of channel 40 is disposed in gap 78. As such, lifter 18 is at least partially held in position through the engagement of end 80 with the interior of side channel 40. The positioning of lifter 18 and engagement bar 70 is important because engagement bar 70 must remain in a predictable position so that engagement bar 70 is seated in a slot 84 disposed in door 22 when hood 14 is placed on receptacle 12.

Door 22 includes side panels 86 each having an arm 88 projecting outwardly therefrom. Slots 84 are formed in side panels 86. Side panels 86 and arms 88 cooperate to carry a front surface 90 of door 22. Both side panels 86, arms 88 and front surface 90 are configured to fit within hood 14 and create a tight fit between door 22 and hood 14 to substantially close opening 20 when door 22 is in the closed position. In the preferred embodiment of the present invention, hood 14 is dome-shaped thus causing door 22 to be similarly shaped. However, in other embodiments of the invention, hood 14 need not be dome-shaped and thus, the shape of door 22 would change accordingly. No matter what the shape of hood 14 may be, hood 14 must provide space for door 22 to roll back into hood 14.

Door 22 is pivotally carried in hood 14 by a pair of pivot pins 92 that extend outwardly from the lower end of each arm 88. Pivot pins 92 are held by an exterior lip 94 that projects from hood 14. The pivotal connection allows door 22 to be rotated or rolled between the closed position depicted in FIG. 6 and the open position depicted in FIG. 7.

The location of pivot pins 92 causes door 22 to move along a fixed arcuate path between the open and closed positions. In the preferred embodiment, the arcuate path follows the contour of hood 14. However, hood 14 may be shaped differently and door 22 would still follow the same path. Nevertheless, the path of door 22 could be obviously altered by moving the locations of pivot pins 92 and changing the dimensions of arms 88. Door 22 is said to roll back into hood 14 because door 22 is moving about pivot pins 92 to produce a rotational movement. Such movement prevents door 22 from passing into the useful areas of receptacle 12 and does not create an undesirable vacuum that may draw bacteria into the air.

The movement of door 22 between the closed position and the open position may be accomplished in two ways. First, when pedal 16 is depressed, lifters 18 are forced upwardly into slots 84. As lifters 18 rise, arm 88 and slots 86 act as a cam and door 22 is rotated about pivot pins 92 towards the open position. When the user releases pedal 16, the weight of door 22 and lifters 18 cause door 22 to fall back into the closed position. Pedal 16 also simultaneously returns to the resting position.

Figure 6:
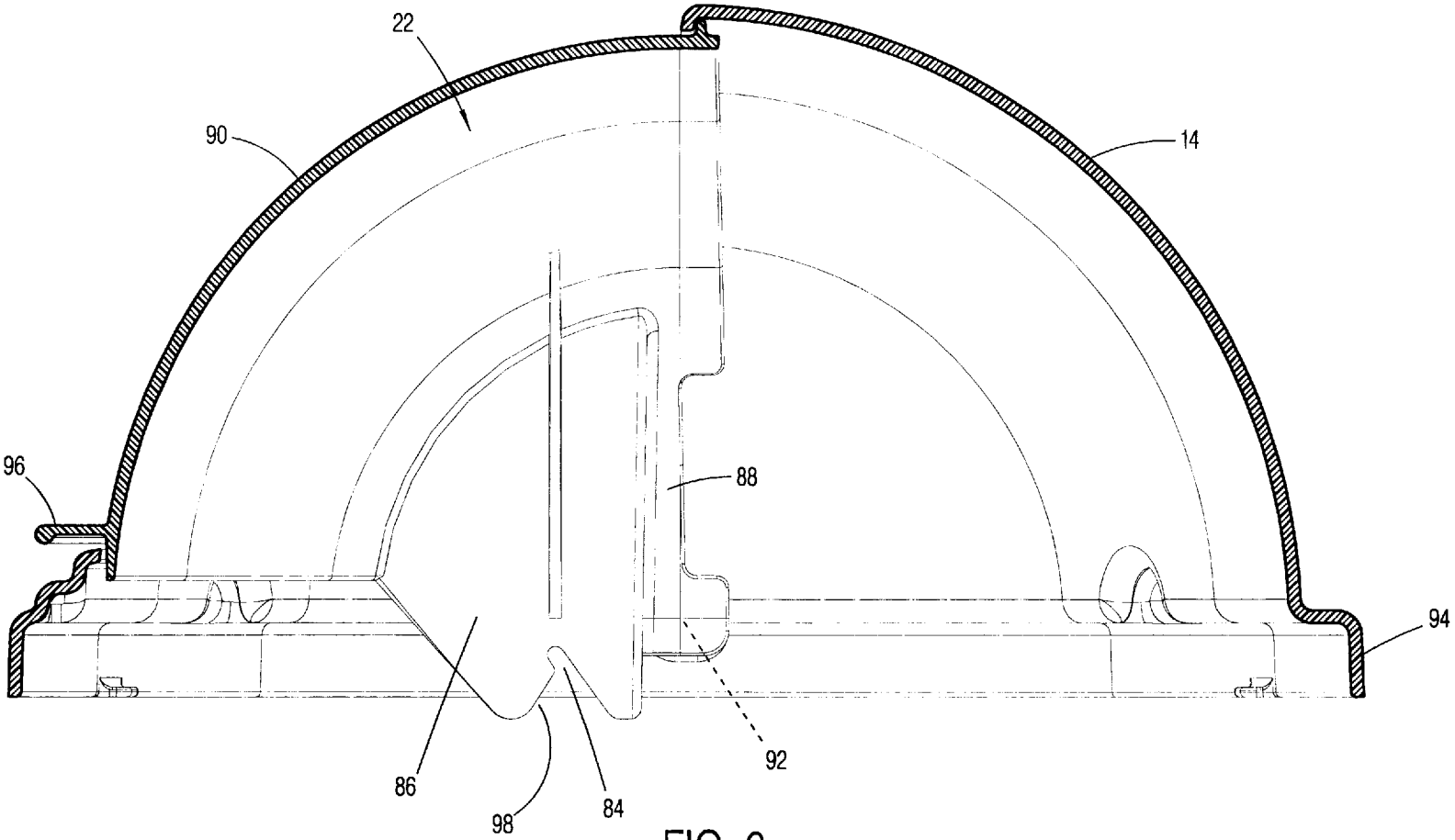
FIG. 6 is a sectional view of the hood of the refuse container taken substantially along line 6—6 of FIG. 4.
Figure 7:
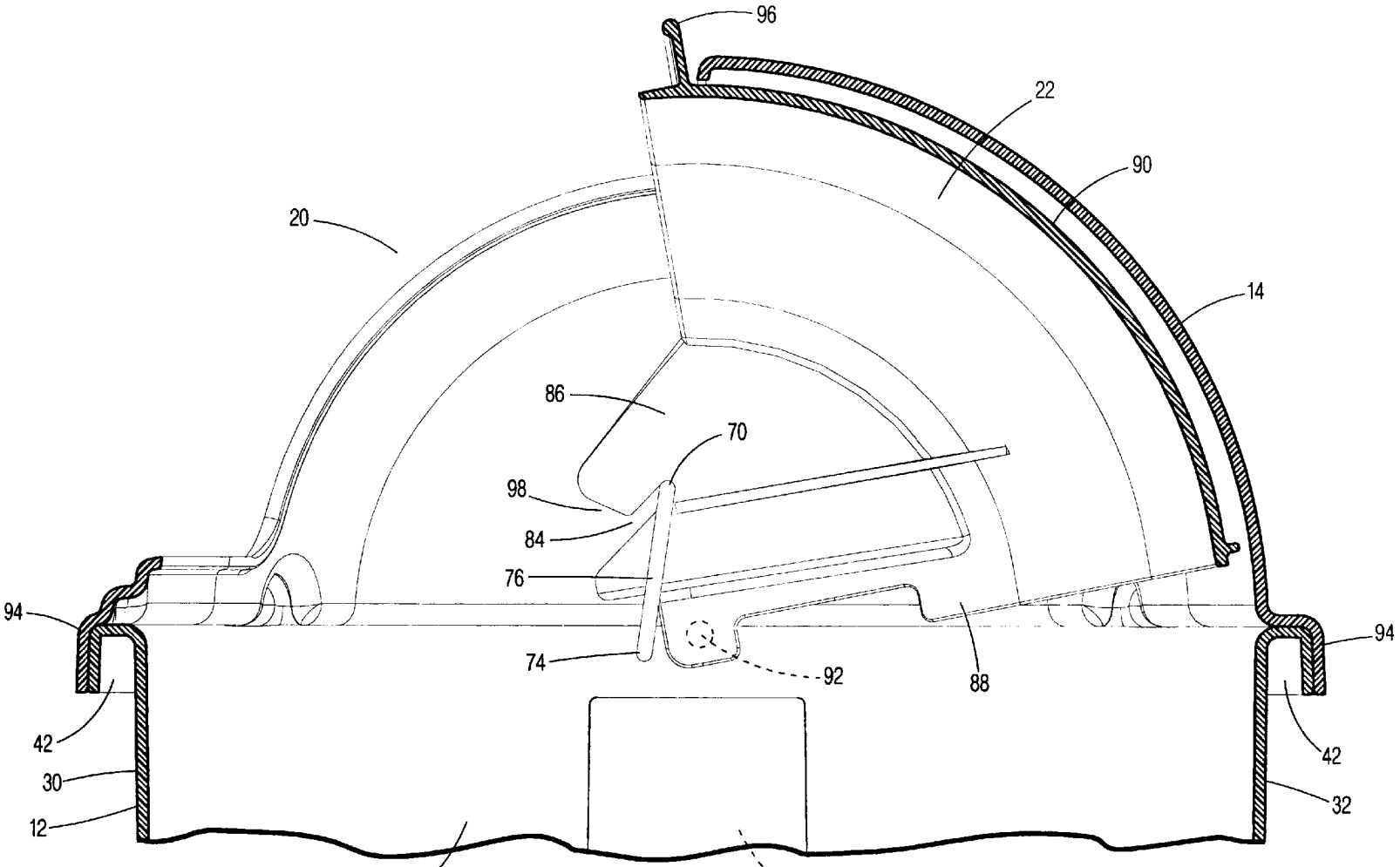
FIG. 7 is a sectional view similar to FIG. 6 depicting the hood and part of the base of the refuse container with the door being shown in the open position.
Figure 8:
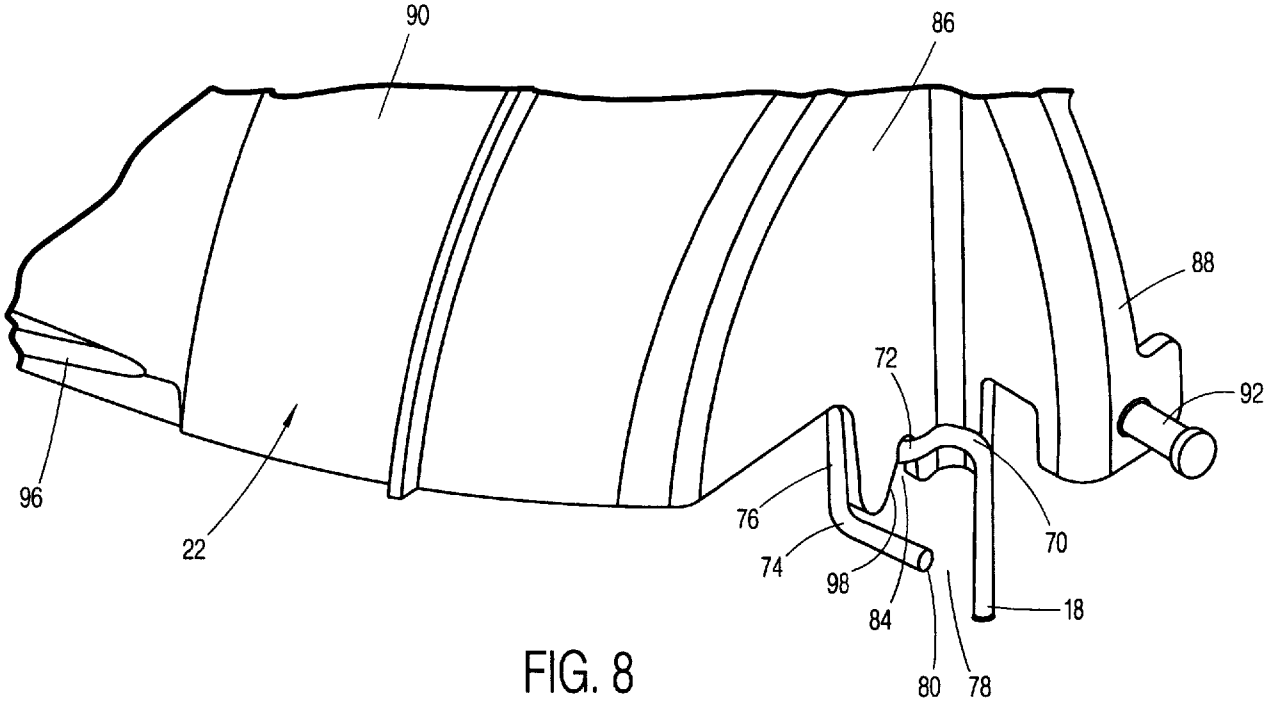
FIG. 8 is a fragmented perspective view of the door of the refuse container and a portion of one of the lifters.

Door 22 may also be rolled back into the open position through the use of a handhold 96. Container 10 is configured such that a user can grasp handhold 96 and lift or push door 22 back into the open position. When this occurs, lifters 18 become disengaged from slot 84 and remain at rest. Thus, pedal 16 does not move when door 22 is opened through the use of handhold 96. When the user releases handhold 96, the weight of door 22 causes it to roll forward into the closed position. It is thus important that slots 84 and arms 88 are configured to permit the automatic engagement of bar 70 of lifters 18. As can be seen in FIGS. 6–8, slot 84 has been cut away in the area indicated by the numeral 98 so that engagement bars 70 can easily be received back into slots 84. In addition to the widened slots 84, engagement bar 70 has curved portion 72, as described above, to seat arm 88 in the center of the engagement bar 70. Moreover, the upper portions of lifters 18 are retained in a predictable position by receptacle 12 through the cooperation of bridge 46 and protuberance 48. Further, the upper end of lifters 18 are retained by the engagement of the end 80 of horizontal portion 74 with the interior of channel 40.

Thus, it should be appreciated that the linkage between door 22 and pedal 16 is automatically formed when door 22 falls back into the closed position causing lifters 18 to engage slots 84. It can also be understood that this linkage is automatically formed when hood 14 is placed on receptacle 12 when door 22 is in the closed position. Furthermore, it should be evident that the user need not disconnect or disassemble anything to remove hood 14 from receptacle 12. Such disconnection or disassembly automatically occurs as the user removes hood 14 from receptacle 12. When hood 14 is removed, engagement bar 70 slides out of slot 84 and the linkage between pedal 16 and door 22 is broken automatically.

It should thus be evident that a receptacle having a pedal operated roll-back door made in accordance with the concepts of the present invention not only provides a receptacle having a removable lid, but also a receptacle that provides a lid that does not interfere with the operation of the refuse container. The refuse container described herein thus accomplishes the objects of the present invention and otherwise substantially improves the refuse container art.

We claim:

1. A refuse container comprising an open-top receptacle, a removable hood selectively closing said open-top of said receptacle, a door carried by said hood, said door being moveable between an open position and a closed position, a foot pedal carried by said receptacle, and a link between said pedal and said door such that said door is moved to said open position from said closed position when said pedal is depressed, said link between said door and said pedal being disassembled upon removal of said hood from said receptacle.

2. A refuse container according to claim 1 wherein said pedal contacts the surface on which said receptacle is placed when said door is in said open position.

3. A refuse container according to claim 1 wherein said door includes a pair of arms and a pivot pin extending from each of said arms, said door pivotally supported in said hood by said pins.

4. A refuse container according to claim 1 wherein said link includes at least one lifter having an upper end and a lower end, said lower end of said lifter operatively connected to said pedal, said upper end of said lifter removably engaging said door.

5. A refuse container according to claim 4 wherein said door includes a slot, said upper end of said lifter selectively being received in said slot to engage said door.

6. A refuse container according to claim 5 further comprising an engagement bar extending from said lifter, said engagement bar disposed to be received in said slot when said lifter is urged upwardly by said pedal.

7. A refuse container according to claim 6 wherein said engagement bar has a curved portion therein for centering said door.

8. A refuse container according to claim 6 further comprising a horizontal portion connected to said engagement bar by a vertical portion such that a gap is formed between an end of said horizontal portion and said lifter, a portion of said receptacle being disposed in said gap.

9. A refuse container according to claim 1 wherein said link is moveably restrained by said receptacle.

10. A refuse container according to claim 9 wherein said receptacle has an inset channel, said link being substantially disposed in said inset channel.

11. A refuse container according to claim 10 further comprising a protuberance in said inset channel, said link slidingly engaging said protuberance.

12. A refuse container comprising a body having an opening therein, an outer cover having a door therein, said door carried by said body between a closed position where said door and said outer cover substantially closes said opening and an open position, a pedal carried by said body, and a linkage operatively connecting said door to said pedal whereby said door is moved to said open position when said pedal is depressed, said door being disassembled from said linkage upon manual movement of said door to said open position while said door is still being carried by said body.

13. A refuse container according to claim 12 wherein said linkage includes at least one lifter having a first end and a second end, said first end of said lifter operatively connected to said pedal and said second end of said lifter removably engaging said door.

14. A refuse container according to claim 13 wherein said door has at least one slot therein, said second end of said lifter being received in said slot to engage said door.

15. A refuse container according to claim 14 wherein said door includes a pair of pivot pins, said door pivotally carried by said body on said pivot pins, said door being forced to pivot into said open position when said lifter is moved upwardly by said pedal.

16. A refuse container according to claim 15 wherein said second end of said lifter is removed from said slot when said door is manually moved to said open position.

17. A refuse container comprising an open-top receptacle, a removable hood selectively closing said open-top of said receptacle, a door carried by said hood, said door moveable between an open position and a closed position, a foot pedal carried by said receptacle, and a link between said pedal and said door such that said door is moved to said open position from said closed position when said pedal is depressed, said link including at least one lifter selectively connecting said pedal to said door, said lifter being disassembled from said door upon removal of said hood from said receptacle.

18. A refuse container according to claim 17 wherein said lifter is operatively connected to said door when said hood is placed on said receptacle.

19. A refuse container comprising an open-top receptacle, a removable hood selectively closing said open-top of said receptacle, a door carried by said hood, said door moveable between an open position and a closed position, a foot pedal carried by said receptacle, and a link between said pedal and said door such that said door is moved to said open position from said closed position when said pedal is depressed, said receptacle movably retaining said link in a position so that when said hood is placed on said receptacle said link is connected between said pedal and said door.

* * * * *